United States Patent [19]

Paul

[11] 4,084,495

[45] Apr. 18, 1978

[54] APPARATUS FOR COLLECTING AND HANDLING RECYCLEABLE PAPER

[76] Inventor: Roy A. Paul, 2902 Wycliff Rd., Raleigh, N.C. 27607

[21] Appl. No.: 728,462

[22] Filed: Sep. 29, 1976

Related U.S. Application Data

[62] Division of Ser. No. 546,412, Feb. 3, 1975, Pat. No. 3,983,799.

[51] Int. Cl.[2] ..... B65B 13/02

[52] U.S. Cl. ..... 100/34

[58] Field of Search ..... 100/1, 2, 3, 34, 25; 211/50; 108/55.1; 214/370, 372; 206/386, 442

[56] References Cited

U.S. PATENT DOCUMENTS

| | | | |
|---|---|---|---|
| 1,720,449 | 7/1929 | Seligman | 100/34 |
| 1,934,289 | 11/1933 | White | 214/372 |
| 2,182,005 | 12/1939 | Stetson | 214/372 |
| 2,639,037 | 5/1953 | Friend | 100/34 |
| 2,757,603 | 8/1956 | Wilson | 100/226 |
| 3,357,344 | 12/1967 | Pate | 100/34 |
| 3,439,605 | 4/1969 | Hanley | 100/34 |
| 3,451,573 | 6/1969 | Josephian | 214/515 |
| 3,463,079 | 8/1969 | Corbett | 100/255 |
| 3,556,326 | 1/1971 | Cline | 214/6 S |
| 3,613,567 | 10/1971 | Loughran | 100/255 |

*Primary Examiner*—Billy J. Wilhite
*Attorney, Agent, or Firm*—Mills & Coats

[57] ABSTRACT

A method and apparatus for collecting and handling recycleable waste paper wherein paper is formed into a stack, baled, transferred to an intermediate transfer device such as a hand truck and transported to an area where the stack of baled paper is transferred to a primary transfer device such as motor truck vehicle of the common highway or road type.

To collect the paper and to form the same into a stack, there is provided a collection box or receptacle that is adapted to receive the paper with sheets or portions of the paper being stacked so as to form an upright stack. The collection box is particularly adapted to allow strapping or bonding material to be wrapped and inserted around the stack of paper while still being supported within the box or receptacle, thereby allowing the entire stack of paper to be bound or baled prior to removal from the collection box.

2 Claims, 9 Drawing Figures

APPARATUS FOR COLLECTING AND HANDLING RECYCLEABLE PAPER

This is a division, of application Ser. No. 546,412, filed Feb. 3, 1975 now U.S. Pat. No. 3,983,799.

The present invention relates to paper recycling, and more particularly to an apparatus for collecting and handling recycleable paper.

In the past few years it has become economically feasible in some cases to recycle paper, especially where large quantities of good quality paper is available and can be collected. While paper recycling is being done today, one often finds the system of collection and handling the paper to be quite inefficient and undesirable. In fact, the inefficiencies in paper collection and handling methods employed by paper collection firms is often responsible for such paper collection businesses being unprofitable.

The present invention presents an apparatus for collecting recycleable waste paper at one facility and packaging that paper such that it can be easily and readily transferred from a receiving area to a storage facility or to the actual paper recycling facility. More particularly, the method of the present invention entails first the forming of the paper into a stack in the general area where the paper becomes substantially valueless except for the material value of the paper itself. In this area, the waste paper, as it is referred to herein, is stacked in an open front box to a certain height with the sheets of the paper being disposed in generally horizontal overlying planes. After the stack of paper has been formed in the box, the stack is bound by strapping material and the baled stack is transferred from the box to an intermediate transfer device such as hand truck.

Once the baled stack of paper has been transferred to the intermediate transfer device, the stack of paper is transported from the actual collection site to a second site where the stack of baled paper is transferred to a primary transfer device such as a motor truck of the type commonly used in transporting material over the public highways. After transfer to the primary transfer device, the baled stacks of paper received at the second site are then transported by the primary transfer device to a third site which could typically be a storage area for the paper collected or the primary transfer device could actually be used to transport the baled paper stacks directly to a recycling facility.

It is, therefore, an object of the present invention to provide an efficient system for collecting recycleable waste paper and handling the same between a collection site and a storage or paper recycling facility.

A further object of the present invention is to provide a collection box compatible with the method of collecting and handling the recycleable waste paper disclosed herein.

Still a further object of the present invention is to provide a collection box of relativey simple construction that will enable paper received therein to be formed into an upright stack and to be completely bound with strapping material prior to being removed from the collection box.

A further object of the present invention resides in the provision of a recycleable waste paper collection box that will allow strapping material to be placed completely around the stack without requiring the stack of paper to be removed from the collection box.

Another object of the present invention is to provide a collection box design for receiving recycleable waste paper that is relatively simple in construction, easy to manufacture, and relatively inexpensive.

Other objects and advantages of the present invention will become apparent from a study of the following description and the accompanying drawings which are merely illustrative of the present invention.

Figure 1:
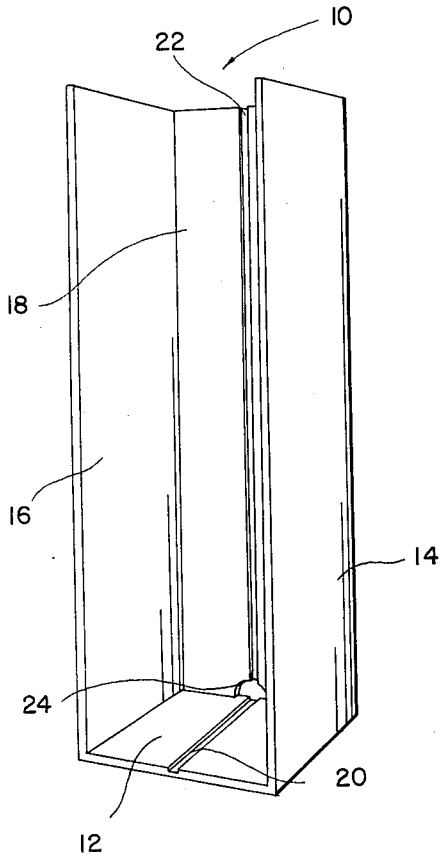
FIG. 1 is a perspective view of the paper collection box as viewed from the front and to one side.
Figure 2:
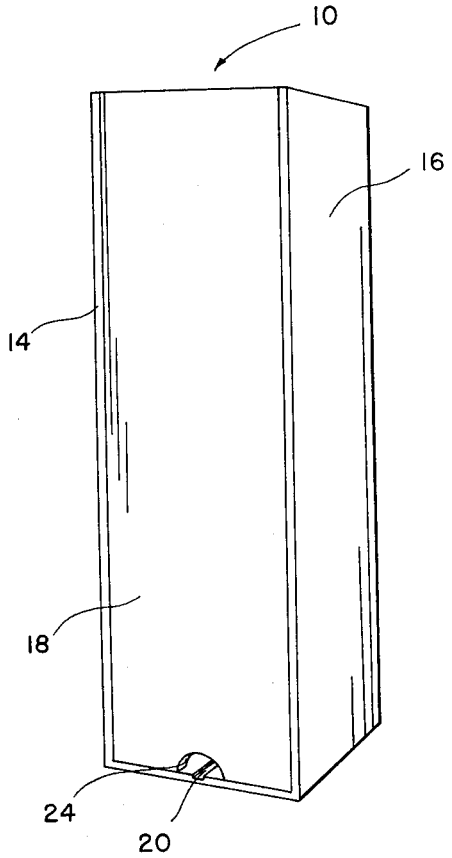
FIG. 2 is a perspective view of the collection box as viewed from the back and to one side.

With further reference to the drawings, particularly FIGS. 1 and 2, a paper collection box is shown therein and indicated generally by the numeral 10, the collection box 10 being utilized to receive and support a stack of paper P therein. Viewing the collection box 10 in greater detail, it is seen that the same as illustrated in FIGS. 1 and 2 is of an open front and top construction and comprises a bottom 12 with a pair of laterally spaced sides 14 and 16 extending upwardly therefrom. Also, there is provided a back 18 that joins the rear edges of the sides 14 and 16 and forms a back against which a portion of the paper stack may rest thereagainst. The bottom 12 is provided with a central groove 20 that extends from front to the back of the bottom, and in like manner the back 18 includes a groove 22 formed along the interior side thereof. Grooves 20 and 22 are of sufficient width and depth to allow conventional strapping or baling material to be threaded through the same while a stack of paper P is disposed within the collection box 10 and supported such that portions of the stack lie adjacent both the bottom 12 and back 18.

There is provided a finger opening 24 formed in the lower edge of the back 18 in alignment with the grooves 20 and 22. It follows that during the paper baling operation, that an individual may insert his fingers through opening 24 to manipulate and guide the strapping material from one of the grooves (20 or 22) to the other groove.

Figure 3:
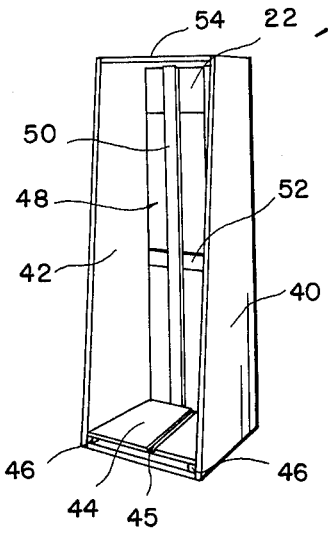
FIG. 3 is a perspective view of an alternate design for the collection box, the view being from the front and to one side.
Figure 4:
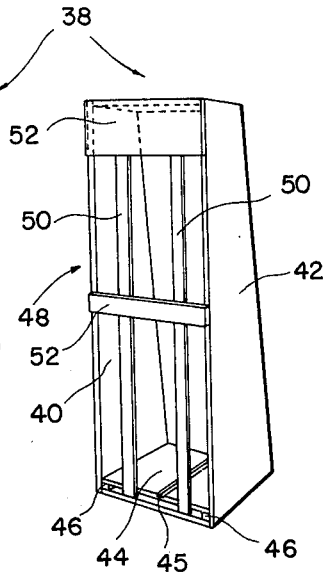
FIG. 4 is another perspective view of the alternate design of the collection box as viewed from the back and to one side.
Figure 5:
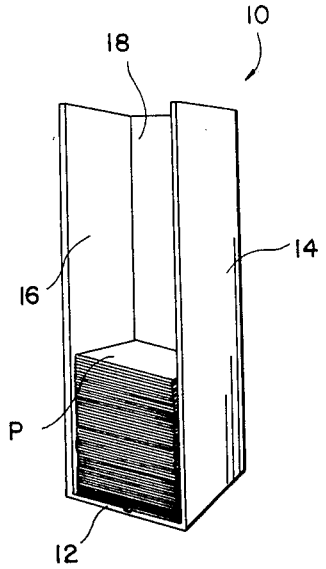
FIG. 5 is a perspective view of the collection box (similar to FIG. 1) with the collection box having a quantity of paper stacked therein.

Turning briefly to FIGS. 3 and 4, there is shown therein an alternate design for the collection box, and this alternate design is indicated generally by the numeral 38. In the case of this alternate design, it is seen that the same comprises a pair of laterally spaced apart sides 40 and 42 and a removable bottom 44 that is generally supported about the upper surface of two longitudinally extending runners 46. Bottom 44 includes a groove 45 similar to groove 20 formed in the bottom 12 of the collection box 10 previously described herein.

Disposed about the back of the alternate collection box design 38 is a back retaining structure indicated generally by the numeral 48 and the same includes a pair of laterally spaced vertically extending vertical strips 50 reenforced by several cross members 52 fixed to the back side thereof and extending thereacross where the cross members are secured by suitable fixing means (such as nails, screws or the like) to the rear edge of the vertical sides 42 and 40. Finally, a top 54 may be provided about the top portion of the alternate design collection box 38.

Figure 6:
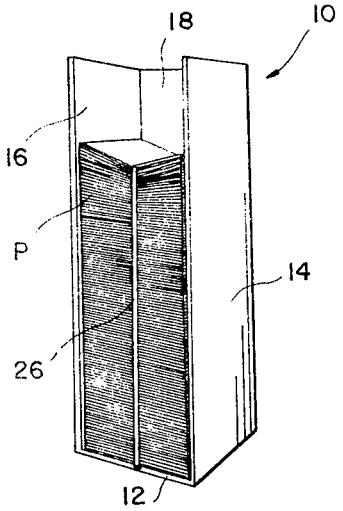
FIG. 6 is a perspective view of the collection box with a full stack of paper shown therein and with the strapping material tightly secured therearound to form a bale of paper.

With reference to the method of paper collection and handling suggested by the present disclosure, the collection box 10 is typically placed in an area conveniently close to a source of recycleable paper. The box 10 can be dimensioned so as to be compatible with various size paper and it should be appreciated that such a collection box 10 and method of collection disclosed herein is particularly suitable to businesses that have large quantities of paper such as computer print-out paper that becomes practically valueless except for the value of the paper itself. As the paper becomes available, it is placed within the box 10 and generally the paper will include a plurality of generally horizontally disposed sheets that are disposed one over the other. After a certain quantity of paper has been received within the box 10, it is seen that the same is formed into an upright stack due to the nature of the box design and due to the manner in which the paper is placed therein. After a stack of a certain size has been formed, then conventional strapping material (flexible metal or plastic strapping) is placed around the stack and the strapping material is properly cut and fastened together by conventional known techniques of baling to form a stack of baled paper. It should be pointed out that the stack of paper is baled while still being disposed within the box 10 and this is accomplished by threading the strapping material down the back 18 along the groove 22 behind the stack of paper. Once the strapping material has been threaded to the lower edge of the back 18, one can insert his fingers through the finger opening 24 and align the strapping material with the groove 20 formed in the bottom 12, and consequently, from the area of the finger opening 24, the strapping material can be pushed underneath the stack of paper where the leading terminal end will emit from the front of the box at which point the same can be pulled up to a convenient fastening position where the other end or portion of the strapping material can be joined in a fastened relationship therewith to form a stack of baled paper such as that viewed in FIG. 6.

Figure 7:
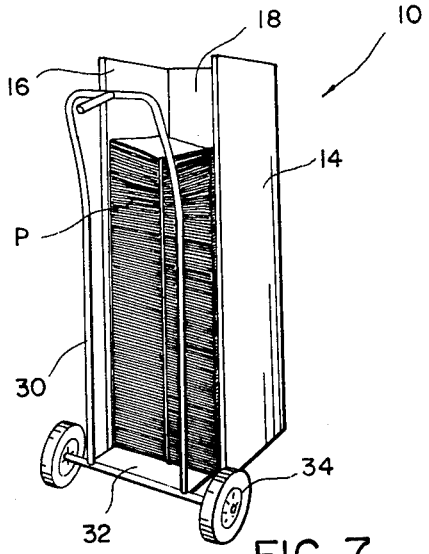
FIG. 7 is a perspective view illustrating the transfer of the collection box and the stack of paper associated therewith onto a hand truck.

Once the paper has been properly baled into a stack, the entire box 10 and stack of paper SP is transferred at the site of collection to an intermediate transfer device such as a hand truck indicated generally by the numeral 28. Briefly reviewing the hand truck 28, it is seen that the same is of the general type having a back frame 30 supported by a pair of relatively mounted wheels 34, and having a lift plate 32 fixed to the lower end of the back frame and projecting forwardly therefrom. The collection box 10, as illustrated in FIG. 7, is typically tilted on its back lower edge and the hand truck 28 is positioned thereunder such that the lift plate 32 supports the collection box 10.

Figure 8:
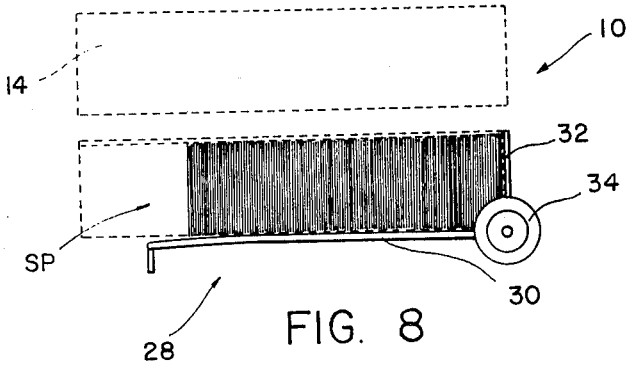
FIG. 8 is a side elevational view of the hand truck and collection box illustrating the collection box being removed from the hand truck while the stack normally associated therewith remains intact with the hand truck.
Figure 9:
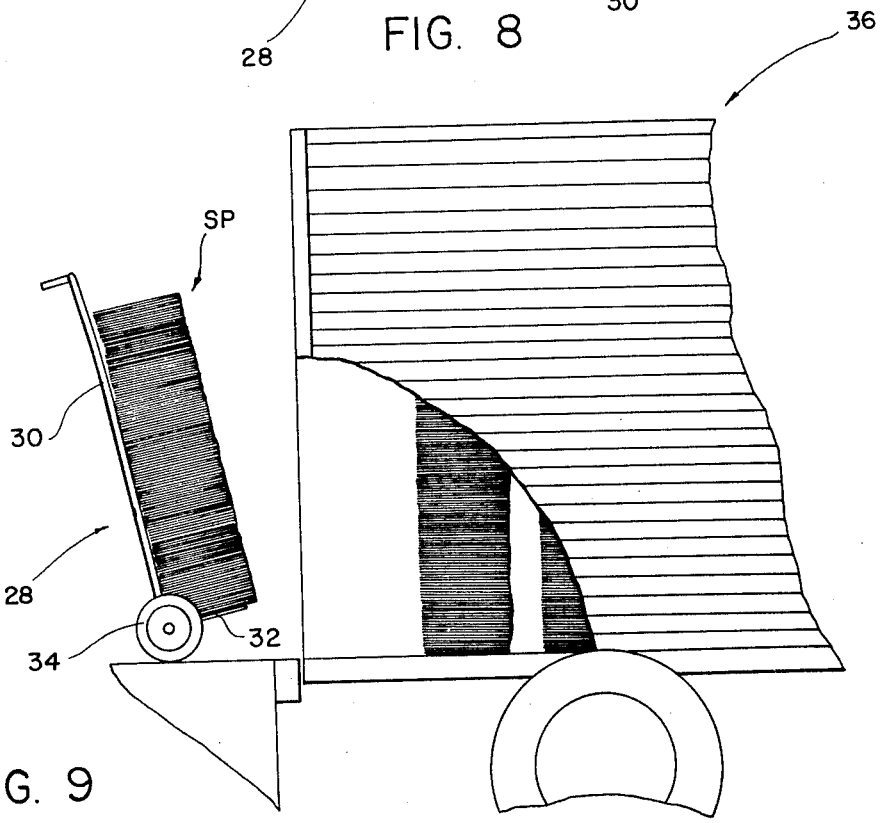
FIG. 9 is a side elevational view illustrating the transfer of the baled stack into a motor truck.

Next, as viewed in FIG. 8, the hand truck 28, is rotated to a generally horizontal position at which time the collection box 10 is grasped and removed from the hand truck 28 leaving the baled paper stack intact with the hand truck 28. After this, the hand truck is used to transport the formed bale of paper to a second transfer site where the stack of paper is transferred to a primary transport device such as the motor truck vehicle indicated generally by the numeral 36 and illustrated in FIG. 9. After certain quantities of baled stacked paper have been received by the motor truck vehicle 36, the truck 36 is utilized to transfer the baled paper from the second transfer site to either a storage facility or to the paper recycling facility itself.

In the case of the alternate collection box design 10, illustrated in FIGS. 3 and 4, it can be said that the basic method and system of collecting recycleable paper and handling the same is generally the same as described with the collection box 10 above. However, it should be noted that in placing the strapping material about the stack of paper while the paper is still within the collection box, in the case of alternate design, the strapping material is actually threaded along the space that lies between the vertical members 50 of the back retaining means 48. Also, in transferring the stack to the intermediate transfer device, the hand truck 28 is positioned such that the lift plate 32 is underneath the removable bottom 44. By tilting the hand truck away from the box 38, the complete baled stack is removed therefrom along with the bottom 44. To remove the bottom 44 from between the stack and the lift plate 32, the hand truck is pivoted to a generally horizontal position such as that assumed in FIG. 8 and the bottom 44 is removed therefrom and placed back in the box 38 to where the same may be utilized in the formation of the next stack of recycleable paper.

It should be pointed out that the stacks of baled paper may be transferred onto pallets for convenience in transferring the stacks of paper from one location to another. Such pallets may be situated withih the truck vehicle 36 or at a central place of storage.

From the foregoing, it is seen that the present invention suggest a convenient and efficient apparatus for collecting and handling recycleable waste paper. Also, it is appreciated that the collection box utilized therein can be of a constructional design that lends itself not only to functionability, but is relatively simple in construction and would be relatively easy to manufacture.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A recycleable waste paper collection box comprising: a relatively tall and narrow box structure having a bottom, a pair of laterally spaced vertically extending side retaining walls extending upwardly from said bottom and disposed generally perpendicular thereto, and a back retaining wall extending upwardly from said bottom and disposed in a plane generally perpendicularly to the plane of said side walls and said bottom, said bottom and side and back retaining walls forming an open front receptacle having a continuous uninterrupted waste paper stacking area forming said bottom of said collection box to the upper portion of said side and back walls for receiving recycleable waste paper therein and confining such waste paper such that access may be readily gained to said collection box and wherein paper may be deposited in said collection box to form a stack of paper; a first elongated strap groove formed about the interior side of said back wall and extending in a generally straight line from a top portion of said back wall to a lower portion thereof; a second elongated strap groove formed about the upper surface of said bottom and which extends from a rear edge of said bottom to a front portion thereof with said second elongated strap groove being aligned with said first strap groove and wherein both said first and second strap grooves are adapted to receive a baling strap therein with the baling strap being used to bale a stack of waste paper formed within said collection box; said first and second strap grooves being grooved into the surface of said back wall and said bottom respectively, with each groove being a depth less than the thickness of the member in which they are formed such that each groove includes a groove bottom and two opposed groove sides, thereby assuring that said back wall and bottom are structurally continuous; and an opening formed about the lower edge of said back wall between and adjacent said first elongated strap groove with said opening so disposed with respect to said back wall and bottom such that the fingers of an individual may be inserted through said opening so as to manipulate and guide a portion of a strap from the first groove around the rear lower edge of the formed stack of paper within said collection box and into said second elongated strap groove in the upper surface of said bottom, thereby allowing said strap to be properly threaded and guided around the formed stack of waste material within said collection box such that the strap may be fastened around the entire formed stack to yield a bale of waste paper.

2. The recycleable paper collection box of claim 1 wherein said first elongated strap groove is formed midway of said back wall and wherein said opening formed in said back wall adjacent and between said first and second strap grooves comprise a generally arcuate shaped opening formed midway about the lower terminal edge of said back wall and aligned with said first strap groove such that said first strap groove terminates directly adjacent said opening.

* * * * *